US009180944B2

(12) United States Patent
Imel et al.

(10) Patent No.: US 9,180,944 B2
(45) Date of Patent: Nov. 10, 2015

(54) DRIVE-ON WATERCRAFT LIFT WITH ADJUSTABLE BUNKS

(75) Inventors: Dustin Imel, Rocky Comfort, MO (US); Adam Strein, Altamont, MO (US); Curtis Downs, Claremore, OK (US); Dan Guthrie, Mooresville, NC (US)

(73) Assignee: E-Z-DOCK, INC., Monett, MO (US)

( * ) Notice: Subject to any disclaimer, the term of this patent is extended or adjusted under 35 U.S.C. 154(b) by 0 days.

(21) Appl. No.: 14/350,193

(22) PCT Filed: Nov. 10, 2011

(86) PCT No.: PCT/US2011/060093

§ 371 (c)(1), (2), (4) Date: Apr. 7, 2014

(87) PCT Pub. No.: WO2013/055378

PCT Pub. Date: Apr. 18, 2013

(65) Prior Publication Data

US 2014/0248083 A1 Sep. 4, 2014

Related U.S. Application Data

(60) Provisional application No. 61/545,395, filed on Oct. 10, 2011.

(51) Int. Cl.

| | |
|---|---|
| ***B63C 3/00*** | (2006.01) |
| ***B63C 3/02*** | (2006.01) |
| ***B63C 3/06*** | (2006.01) |

(52) U.S. Cl.

CPC .... *B63C 3/02* (2013.01); *B63C 3/06* (2013.01)

(58) Field of Classification Search

CPC ..... B32C 3/00; B63C 3/02; B63C 3/04; B63C 3/06; B63C 3/08; B63C 3/12

See application file for complete search history.

(56) References Cited

U.S. PATENT DOCUMENTS

| | | | | |
|---|---|---|---|---|
| 5,695,331 | A | 12/1997 | Nutter et al. | |
| 5,875,727 | A | 3/1999 | Elson et al. | |
| 6,422,167 | B1 * | 7/2002 | Bridges | 114/44 |
| 7,063,033 | B1 | 6/2006 | Jackson | |
| 7,069,872 | B2 * | 7/2006 | Ostreng et al. | 114/263 |
| 7,117,809 | B2 * | 10/2006 | Lamoureux et al. | 114/263 |
| 7,293,522 | B1 * | 11/2007 | Elson | 114/263 |
| 7,552,495 | B1 | 6/2009 | Rogerson | |

(Continued)

OTHER PUBLICATIONS

International Search Report corresponding to International Application No. PCT/US2011/060093 mailed Aug. 27, 2012.

(Continued)

*Primary Examiner* — Benjamin Fiorello

(74) *Attorney, Agent, or Firm* — Polster, Lieder, Woodruff & Lucchesi, L.C.

(57) ABSTRACT

A drive-on watercraft (10) has removable/replaceable bunks (50, 80). The bunks are configured to define two rails (64,66; 94*a,b*). In one embodiment, one rail (64) is higher than the other rail (66). This bunk with rails of different heights can be positioned on the body of the lift with either rail facing inwardly, such that the lift can be configured to receive watercraft of different sizes. In a second embodiment, the bunk (80) has a ramp (84) positioned to extend rearwardly from the back of the lift body when the bunk is mounted to the lift body. The bunk ramp (84) provides a sacrificial point of first contact for of a watercraft with the lift and provides for a softer ride for the watercraft onto the lift.

10 Claims, 12 Drawing Sheets

(56) References Cited

U.S. PATENT DOCUMENTS

| | | | | |
|---|---|---|---|---|
| 7,856,936 | B2 * | 12/2010 | Nemethy | 114/44 |
| 2005/0166822 | A1 * | 8/2005 | Brown | 114/263 |
| 2009/0044740 | A1 * | 2/2009 | Imel et al. | 114/263 |

OTHER PUBLICATIONS

International Written Opinion corresponding to International Application No. PCT/US2011/060093 mailed Aug. 27, 2012.

* cited by examiner

DRIVE-ON WATERCRAFT LIFT WITH ADJUSTABLE BUNKS

CROSS-REFERENCE TO RELATED APPLICATIONS

This application is the US National Stage of International App. No. PCT/US2011/060093 filed Nov. 10, 2011, and which claims priority to U.S. App. No. 61/545,395 filed Oct. 10, 2011, both of which are incorporated herein by reference.

STATEMENT REGARDING FEDERALLY SPONSORED RESEARCH OR DEVELOPMENT

Not Applicable.

BACKGROUND

This application relates to drive-on watercraft lifts, and, in particular, to a watercraft lift having adjustable/replaceable bunks or slide members.

Drive-on watercraft lifts are often provided with rollers or elongate slide members upon which watercraft rest when positioned on the lift. An example of such rollers/glides is shown in U.S. Pat. No. 7,069,872, which is incorporated herein by reference. The rollers/glides disclosed therein are mounted on brackets which allow for the rollers/glides to pivot relative to the watercraft lift, to thereby accommodate watercraft hulls of different sizes or shapes. However, in many watercraft lifts, the rollers/glides are not pivotal, and thus, on many types of watercraft lifts, the rollers/glides or bunks cannot be adjusted or altered to accept watercraft of different sizes.

BRIEF SUMMARY

Briefly stated, removable bunks are provided for a drive-on watercraft lift. The watercraft lift comprises a body having an upper surface, side walls, a front wall, and a back wall. A watercraft hull receiving channel is formed in the upper surface which defines an entrance onto the lift. To accommodate the bunks, a bunk receiving slot is formed in the upper surface on either side of the hull receiving channel (such that there are two bunk receiving slots). The bunk receiving slots extend forwardly from the back wall of the watercraft lift.

A bunk is secured in each of the bunk receiving slots. The bunks each comprise a bottom surface, a first side wall, a second side wall opposite the first side wall, and an upper surface. The upper surface of the bunk defines at least one rail upon which the hull of a watercraft will rest when the watercraft is positioned on the lift.

The bunk receiving slots of the lift body and the bunks are configured to enable the bunks to be removably secured in the bunk receiving slots. According to one aspect, the bunks are frictionally received in the bunk receiving slots. In one embodiment, the bunks include at least one side flange extending outwardly from the bottom of least one of the side walls of the bunk; the side flange giving the bunk an overall width approximately equal to the width of the bunk receiving slot. The side flange can be comprised of discrete sections, such that the flange is not continuous. The overall width of the bunk, including the width of the bunk body and the bunk flange(s) is sized such that the bunk is frictionally received in the bunk receiving slot of the watercraft lift. To further secure the bunk in the bunk receiving slot, the bunks can be formed with fastener receiving holes which align with fastener receiving holes in the bunk receiving slot when the bunk is placed in the bunk receiving slot. Fasteners extend through the fastener receiving holes of the bunks into the fastener receiving holes of the body to secure the bunks in the bunk receiving slots. The fastener receiving slots for the bunks can be formed in tabs extending from opposite ends of the bunk (where the bunk is shorter than the bunk receiving slot), or can extend through the body of the bunk.

According to one aspect of the bunks, the bunk top surface is generally concave such that the bunk defines a first rail associated with the first side wall and a second rail associated with the second side wall. In one embodiment of the bunk, the first side wall is taller than the second side wall, such that the first rail is vertically above the second side rail. In this instance, the bunk can be positioned in the bunk receiving slot with either the first or second side wall facing inwardly. In another embodiment, the bunk is generally symmetrical about a vertical plane extending the length of the bunk and extending through the center of the bunk, and the two side walls of the bunk are of generally the same height.

In accordance with another aspect of the bunks, the bunks can extend beyond the back edge of the watercraft lift and can include a ramp portion positioned at a rear end of the bunk. This ramp portion comprises a sloping ramp surface, opposed side walls and a front wall. The ramp portion front wall can have a height at least equal to a height of the rear wall of the lift body.

BRIEF DESCRIPTION OF THE SEVERAL VIEWS OF THE DRAWINGS

Corresponding reference numerals will be used throughout the several figures of the drawings.

DETAILED DESCRIPTION

Figure 1:
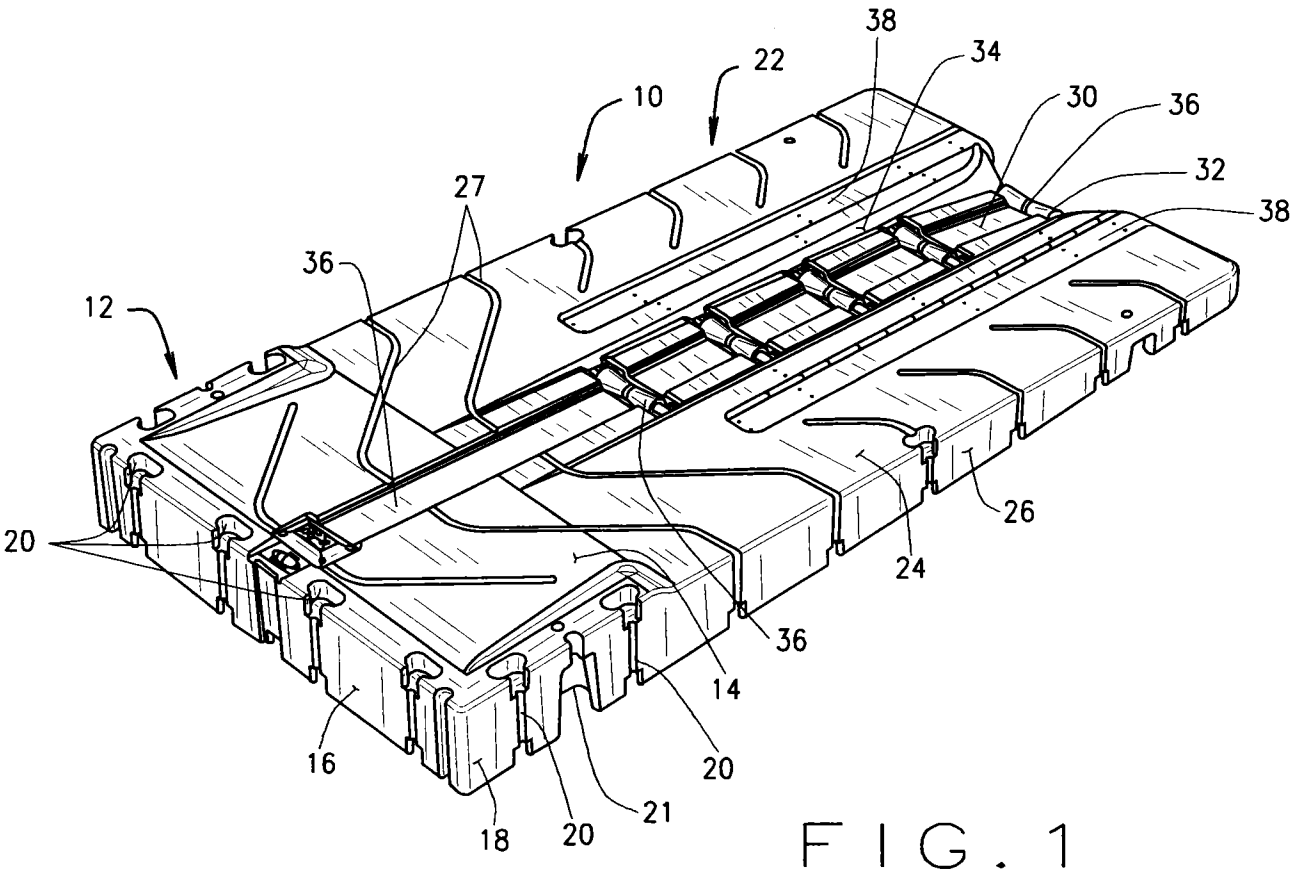
FIG. 1 is a top perspective view of a drive-on watercraft lift adapted to accept adjustable/replaceable bunks.

The following detailed description illustrates the invention by way of example and not by way of claimed limitation. This description will clearly enable one skilled in the art to make and use the claimed invention, and describes several embodiments, adaptations, variations, alternatives and uses of the claimed invention, including what I presently believe is the best mode of carrying out the claimed invention. Additionally, it is to be understood that the claimed invention is not limited in its application to the details of construction and the arrangements of components set forth in the following description or illustrated in the drawings. The claimed invention is capable of other embodiments and of being practiced or being carried out in various ways. Also, it is to be understood that the phraseology and terminology used herein is for the purpose of description and should not be regarded as limiting.

Figure 2:
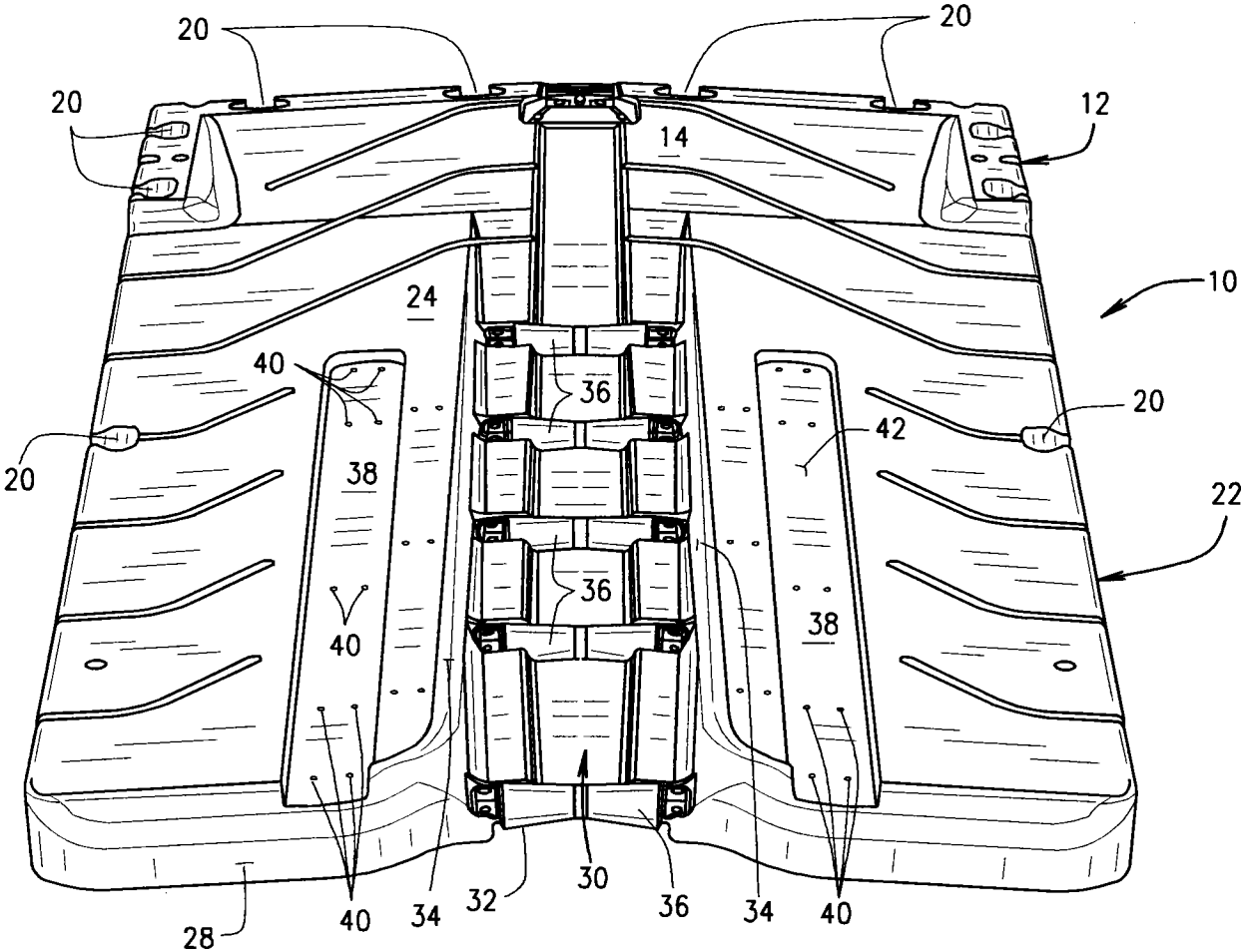
FIG. 2 is a rear perspective view of the watercraft lift.

FIGS. 1 and 2 show a drive-on watercraft lift 10 adapted to receive replaceable bunks. The drive-on watercraft lift 10 includes an upper deck section 12 have a generally level top surface 14, a front wall 16 and side walls 18. The front and side walls include connector receiving slots 20 to enable the lift 10 to be incorporated in a dock system, such as disclosed in U.S. Pat. No. 5,281,055, which is incorporated herein by reference. It should be recognized that other connecting systems can be used to incorporate the lift 10 in a dock system. Additional connector slots 21 are provided to connect or mount attachments to the watercraft lift.

A watercraft receiving section 22 extends rearwardly from the upper deck section 10. The watercraft receiving section 22 includes an upper surface 24, side walls 26 and a rear edge 28. The watercraft receiving section 22 slopes downwardly and rearwardly, such that the side walls 26 are shorter at the rear edge 28 then at the front of the watercraft receiving area. As can be seen, the side walls 26 are a continuation of the side walls 18 of the upper deck section 12. Narrow grooves 27 are formed in the upper surfaces 14 and 24 of the upper deck section 22 and the watercraft receiving section 24. As is known, the grooves 27 facilitate removal of water from the upper surfaces of the watercraft lift.

A first channel 30 forms an entrance 32 to the lift 10, and extends forwardly from the rear edge 28 of the watercraft receiving section 22, and is generally centered between the side walls 26 of the watercraft receiving section 22. The first channel 30 has a steeper slope than the upper surface 24 of the watercraft receiving section 22, and is defined by sloping side walls 34. Rollers 36 are spaced along the first channel 30, with a first roller 36 being positioned at entrance to the channel 30. A second channel 38 extends forwardly from the first channel 30 substantially to the front wall 16 of the lift deck section 12. As seen, the second channel 38 is not as wide as the first channel 30.

A bunk receiving slot 38 is formed on either side of the first channel 30. The slots 38 are parallel to each other and to the first channel 30. The bunk receiving slots 38 extend forwardly from the rear edge 28 of the watercraft receiving area 22, such that the slots are open at the rear edge 28. The slots 38 have a length approximately equal to the length of the first channel 30. Fastener receiving holes 40 are formed in the bottom surface 42 of the channels 38. The fastener receiving holes 40 are shown to be formed in pairs, and are spaced along the channels 38.

Figure 3:
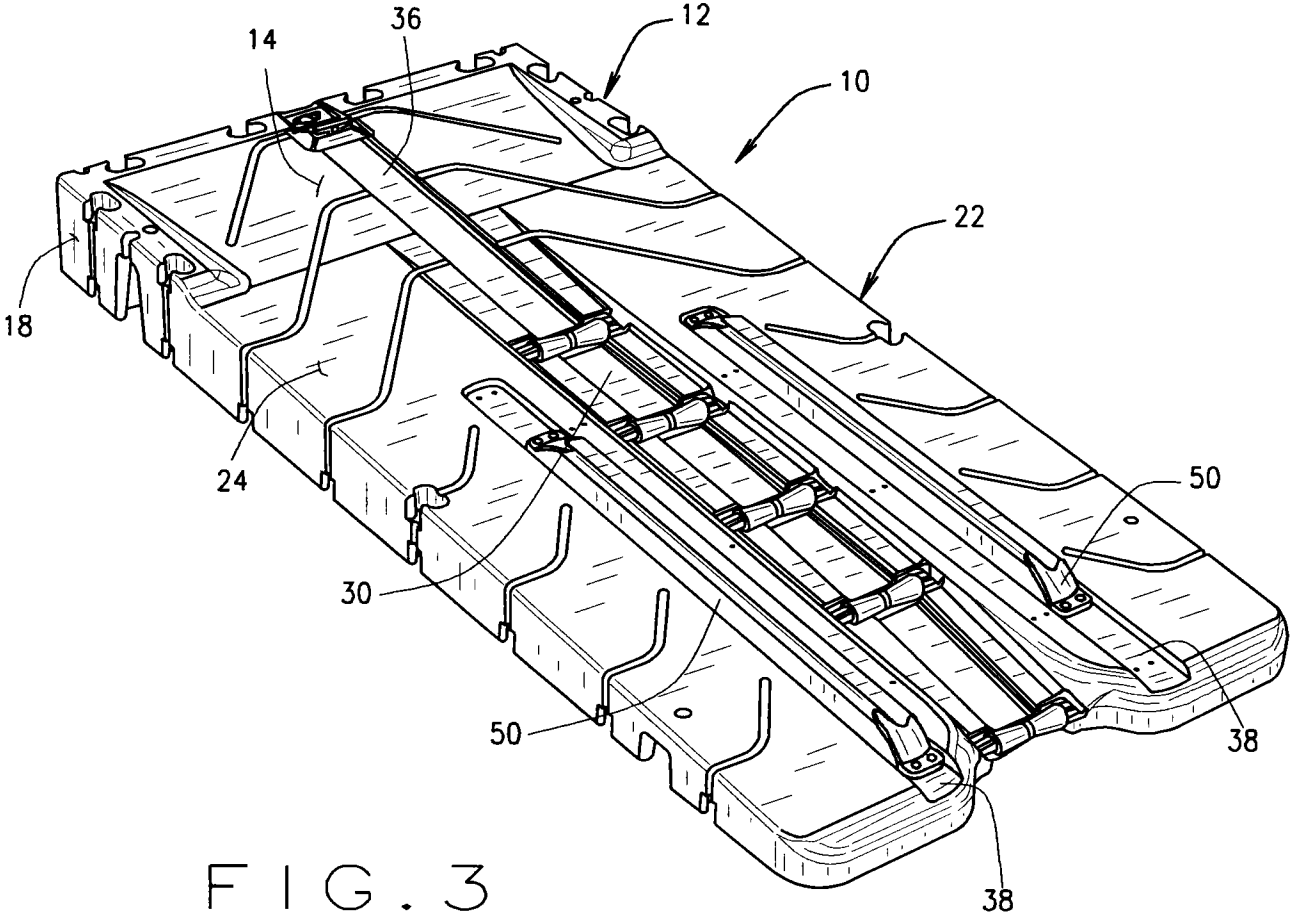
FIG. 3 is a perspective view of the watercraft lift fitted with short bunks.
Figure 4:
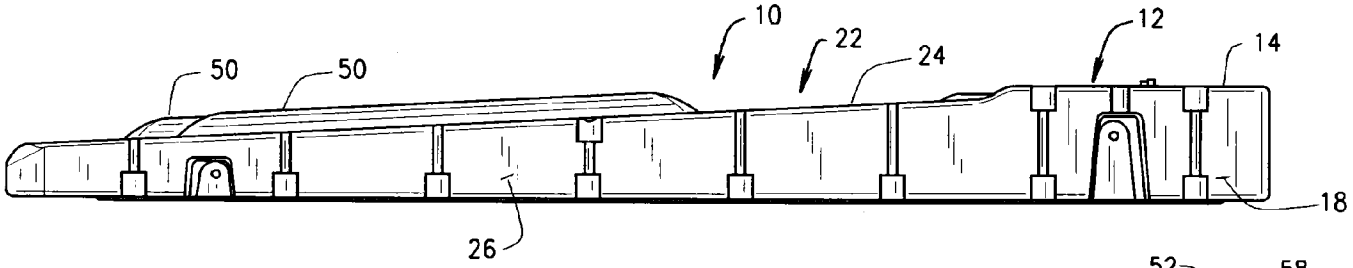
FIG. 4 is a side elevational view of the watercraft lift with the short bunks.

FIGS. 3 and 4 show short bunks 50 positioned in the slot 38. As best seen in FIG. 3, the bunks 50 are shorter than the channel 38. In FIG. 3, one bunk is shown positioned essentially at the rear of its slot, while the other bunk is shown positioned at the forward end of its slot 38. Thus, the two bunks 50 are shown off set from each other. In actual use, the two bunks would each be positioned at the same relative spot in their respective slots, such that the ends of the two bunks would be even with each other. FIG. 3 is drawn to show that the bunks 50 can be positioned at different locations along the slots 38.

Figure 5:
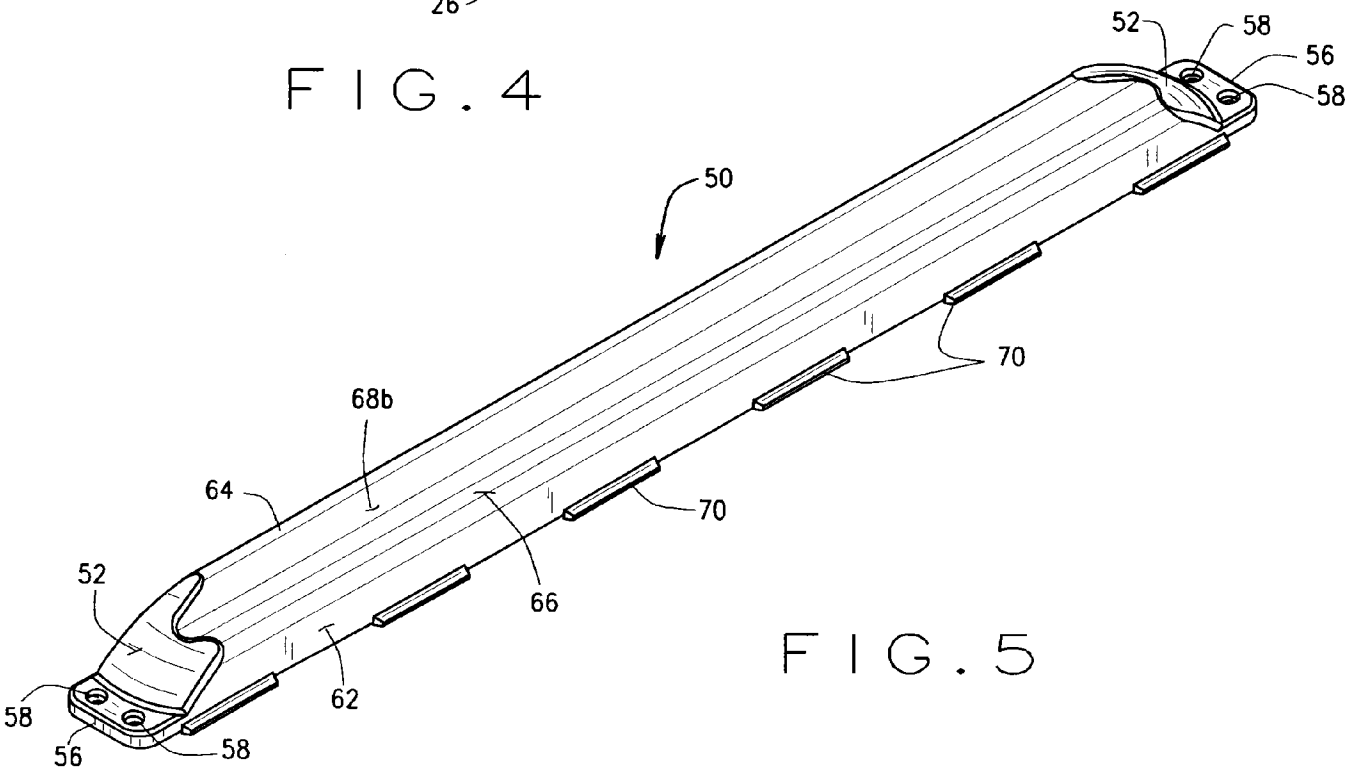
FIG. 5 is a perspective view of the short bunk.
Figure 6:
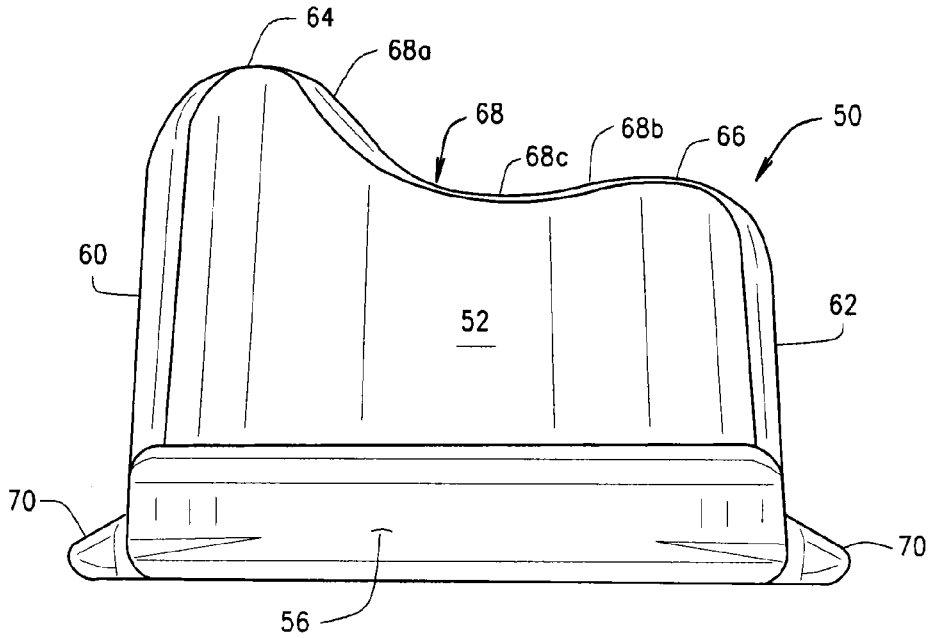
FIG. 6 is an end elevational view of the short bunk.
Figure 7:
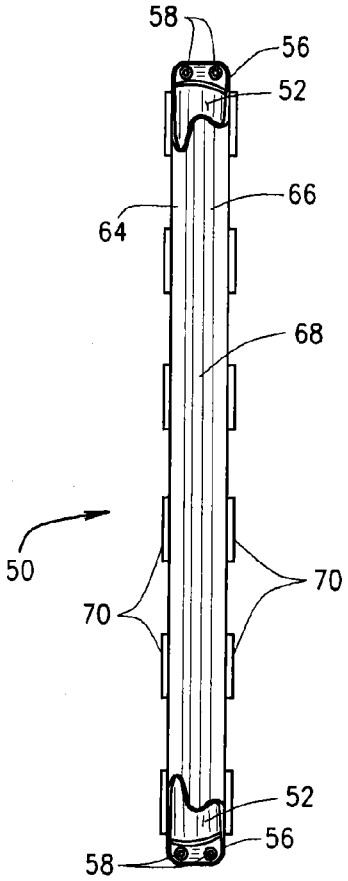
FIG. 7 is a top plan view of the short bunk.
Figure 8:
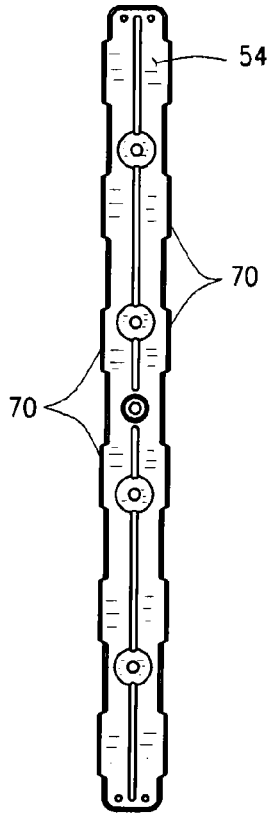
FIG. 8 is a bottom plan view of the short bunk.
Figure 9:
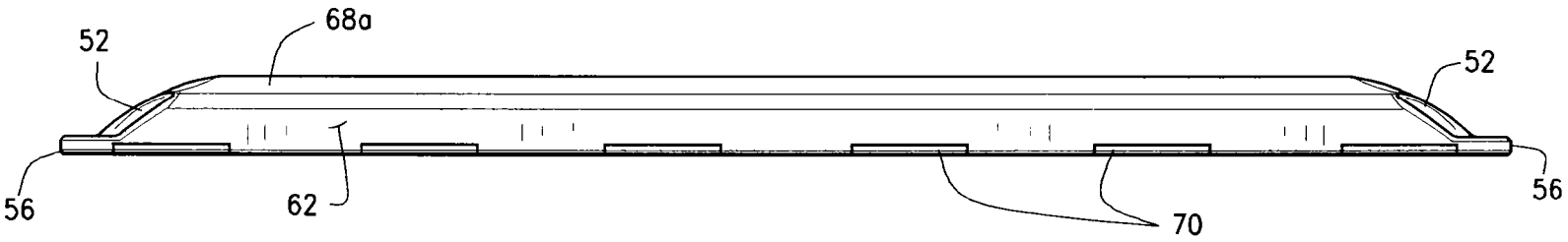
FIG. 9 is a side elevational view of the short bunk from a first side.
Figure 10:
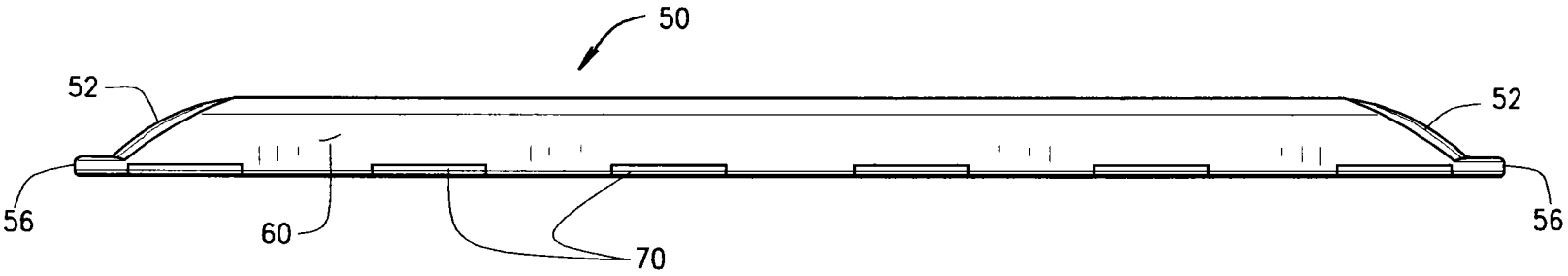
FIG. 10 is a side elevational view of the short bunk from the opposite side of FIG. 9.

The short bunk 50 is shown in more detail in FIGS. 5-10. The bunk 50 has opposed ends 52 which slope upwardly toward each other from the bottom surface 54 of the bunk. An attachment flange or tongue 56 extends from the bottom of each end 52. The flanges 56 include openings 58 through which fasteners extend to secure the bunk 50 in a bunk receiving slot 38 of the lift. The bunk 50 has an overall length (from the end of one flange 56 to the end of the opposite flange) such that the openings 58 align with the fastener receiving holes 40 in the slots 38 of the lift 10. The bunk 50 includes a first side wall 60 and a second side wall 62. As best seen in FIGS. 5 and 6, the first side wall 60 is taller than the second side wall 62. The sidewalls 60 and 62 each end in radiused top surfaces 64 and 66, respectively. A concave surface or channel 68 defined by inner walls **68*a* and 68*b* and a bottom surface 68*c* is formed between the two top surfaces 64 and 66. The two top surfaces 64 and 66 define an upper rail and a lower rail, respectively, which as can be seen are generally parallel and spaced apart from each other. Lastly, the bunk 50 includes a plurality of spaced apart side flanges or ears 70 which extend outwardly from the bottoms of the side walls 60 and 62. Thus, the bottom sides of the flanges 70 (as well as the bottom side of the flanges 56) are coplanar with the bottom surface 54 of the bunk 50, as seen in FIG. 8. The flanges 70 give the bunk 50 an overall width that is substantially equal to the width of the bunk receiving slot 38, such that there is a tight fit of the bunk in the sloth 38. Although shown as discrete flanges, the flanges 70 could be formed as a continuous flange which extends the length of the bunk 50**.

The bunks 50 are secured to the watercraft lift 10 by positioning a bunk 50 in each slot 38 of the lift. The holes 58 of the attachment flanges 56 are aligned with the openings 40 in the slots 50, and a faster (such as a bolt or screw) is driven through the aligned openings to secure the bunk 50 in place. Although the flanges 70 provide, in essence, a friction fit of the bunk in the slot 38, the use of the fasteners is still preferred, so that the position of the bunk in the slot will not be altered, for example, by repeated mounting and dismounting of a watercraft on the boat lift. As noted above, the two bunks are preferably aligned with each other. The bunks 50 can be secured in the slots with the first (taller) wall 60 facing inward or with the second (shorter) wall 62 facing inward. Again, preferably, both the bunks are positioned in the same way (i.e., either both bunks have the second shorter wall facing inwardly or both bunks have the first taller wall facing inwardly). For demonstrative purposes, FIG. 3 shows one bunk with the first wall facing inwardly and the other bunk with the second wall facing inwardly.

When a watercraft is driven onto the watercraft lift, the center (or keel) of the watercraft will be received in the channel 30 of the lift and the hull of the watercraft will rest on the rollers 36. If the bunks 50 are positioned with the first (taller) wall 60 facing inwardly, the hull will rest on the edge or rail 64. If the bunks 50 are positioned with the second (shorter) wall 62 facing inwardly, the hull can rest on one or both of the edges or rails 66 and 64, depending on the slope and width of the hull. Thus, as can be appreciated, the watercraft lift 10 can be configured to accept differently shaped or sized hulls by positioning the bunks with the first or second side wall facing inwardly. Further, the bunks 50 are replaceable. As the lift is used, the bunks 50 will be worn. When the bunks 50 are worn to the point that they are no longer effective, the bunks can simply be replaced with new bunks, thereby extending the useful life of the watercraft lift 10.

Figure 11:
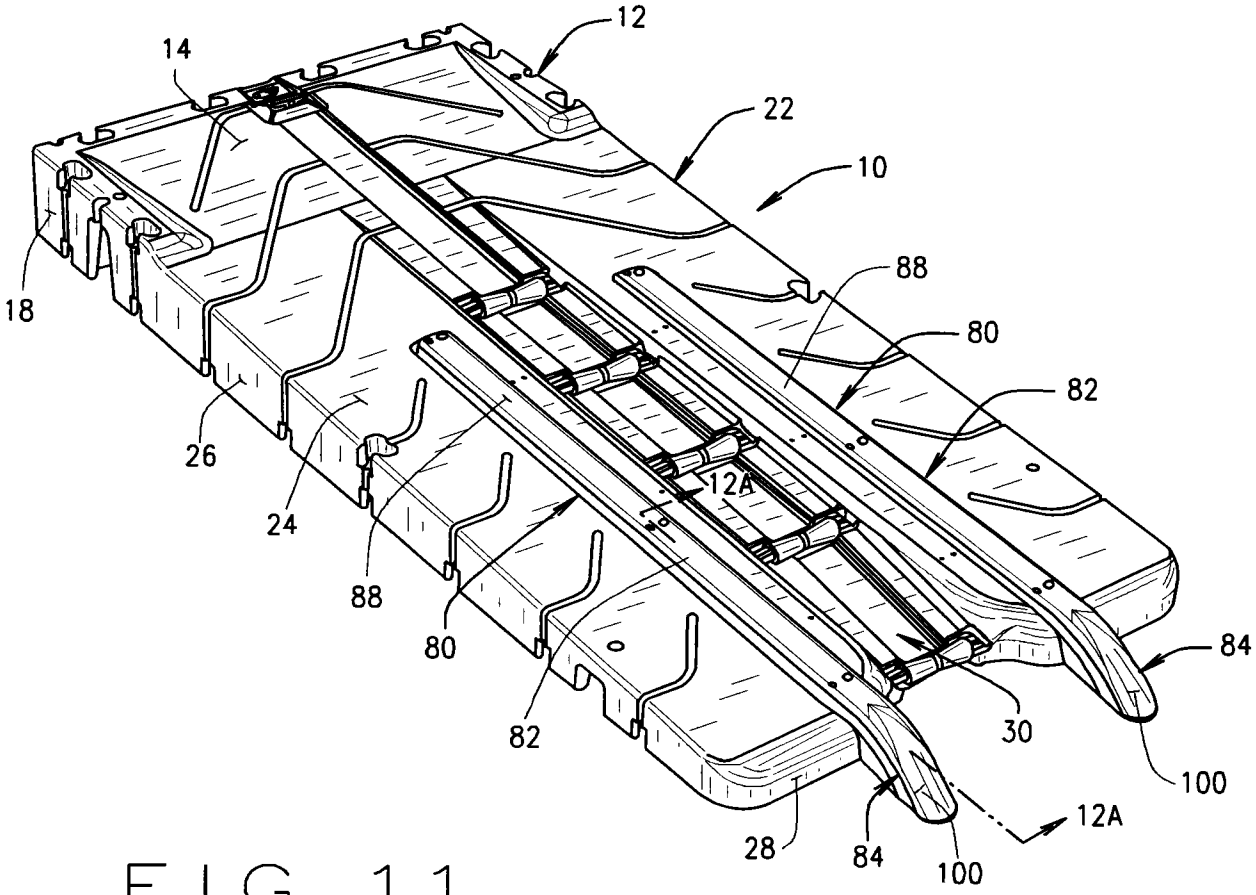
FIG. 11 is a perspective view of the watercraft lift fitted with long bunks.
Figure 12:
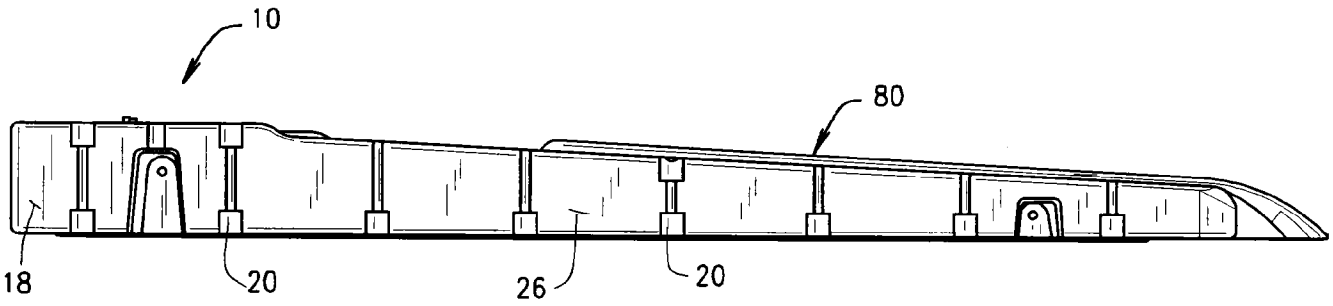
FIG. 12 is a side elevational view of the watercraft lift with the long bunks.
Figure 13:
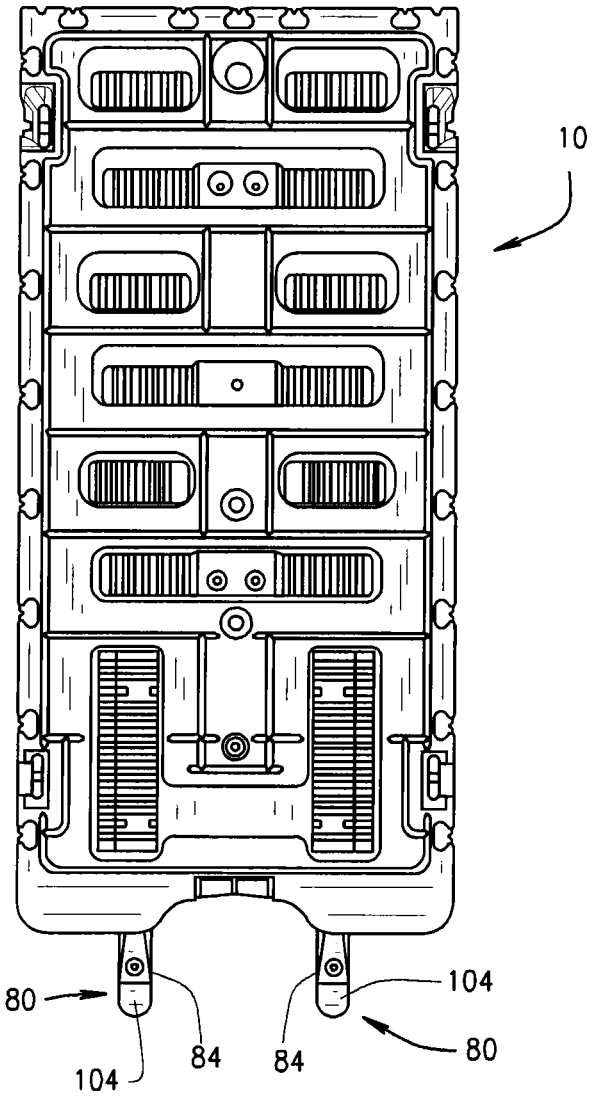
FIG. 13 is a bottom plan view of the watercraft lift with the long bunks.
Figure 14:
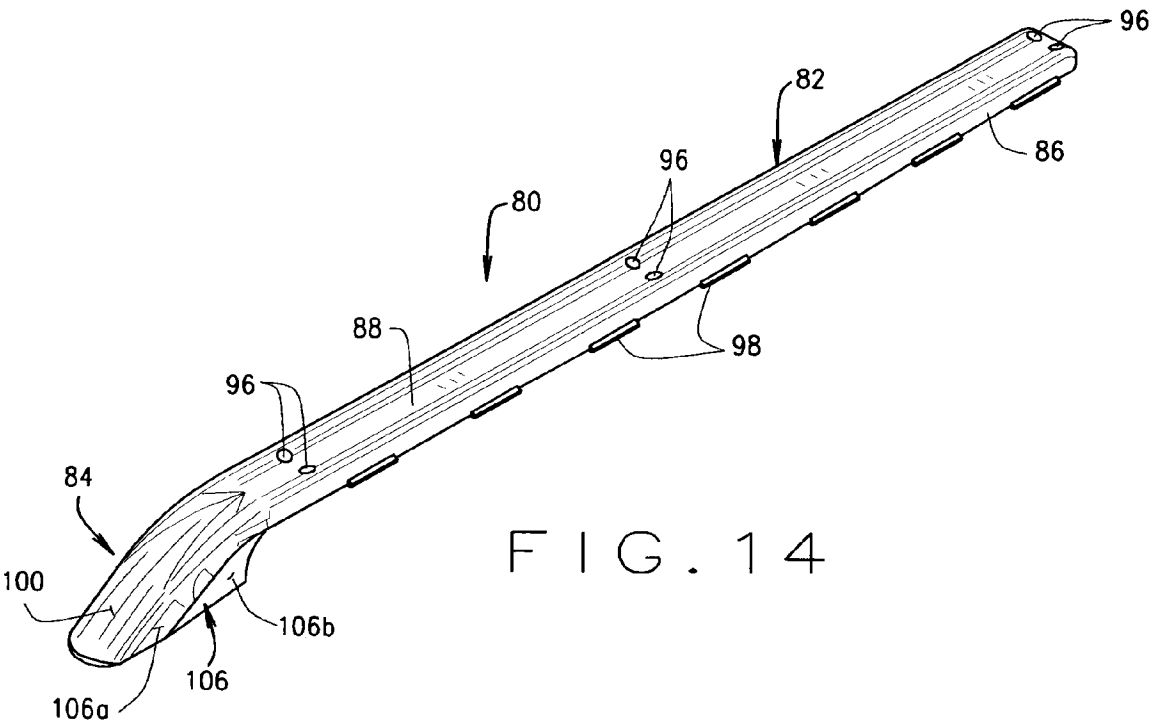
FIG. 14 is a perspective view of the long bunk.
Figure 19:
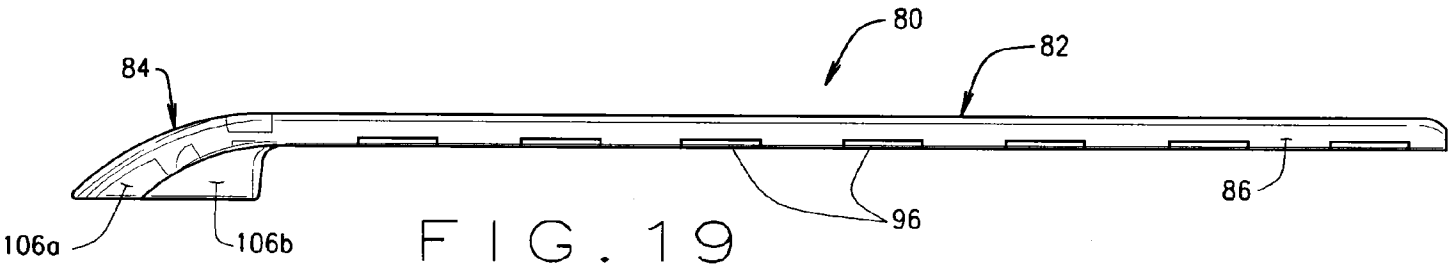
FIG. 19 is a side elevational view of the long bunk.

FIGS. 11-13 show the watercraft lift 10 fitted with long bunks 80. The bunks 80 are shown in more detail in FIGS. 14-19. The bunks 80 include an elongate rail portion 82 which is received in, and extends substantially the full length of, the slots 38 of the watercraft lift 10 and a ramp section 84 which extends rearwardly from the rear edge of the lift 10.

The rail portion 82 of the long bunks 80 include side walls 86, a concave upper surface 88, a bottom surface 90, and a front wall 92. The transition from the side walls 86 to the concave upper surface 88 is rounded, such that the rail portion 82 defines two opposed rounded generally parallel rails 94*a, b*, which are spaced apart from each other. Holes 96 are positioned at discrete locations along the rail upper surface 88 to be aligned with the fastener receiving openings 40 of the lift slots 38. Fasteners (such as screws or bolts, for example) pass through the openings 96 into the openings 40 to secure the bunk 80 in the slot 38. As seen, the rails 94*a,b* are vertically above the holes 96. Hence, the top surface of the fasteners will be below the top of the rails 94*a,b*, and thus, the fasteners will be effectively "hidden" from a watercraft positioned on a lift fitted with the bunks 80. This will reduce the possibility of the fasteners marring the watercraft hull. Lastly, the rail portion 82 includes flanges 98 which extend outwardly from the bottom of the side walls 86. The flanges 98, like the flanges 70 of the short bunk 50 give the bunk 80 an overall width substantially equal to the width of the bunk receiving slot 38 of the float 10, such that the bunk 80 is frictionally received in the slot 38.

Figure 12A:
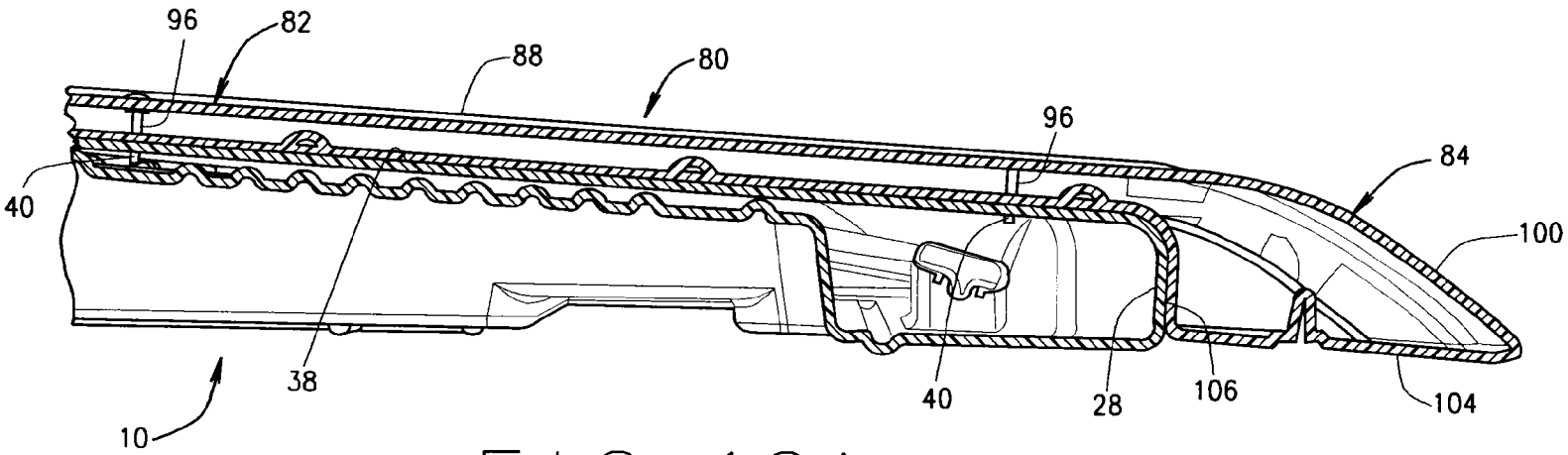
FIG. 12A is an enlarged fragmentary, cross-sectional view of the boat lift taken along the line 12A-12A of FIG. 11, showing a long bunk positioned on the lift.
Figure 16:
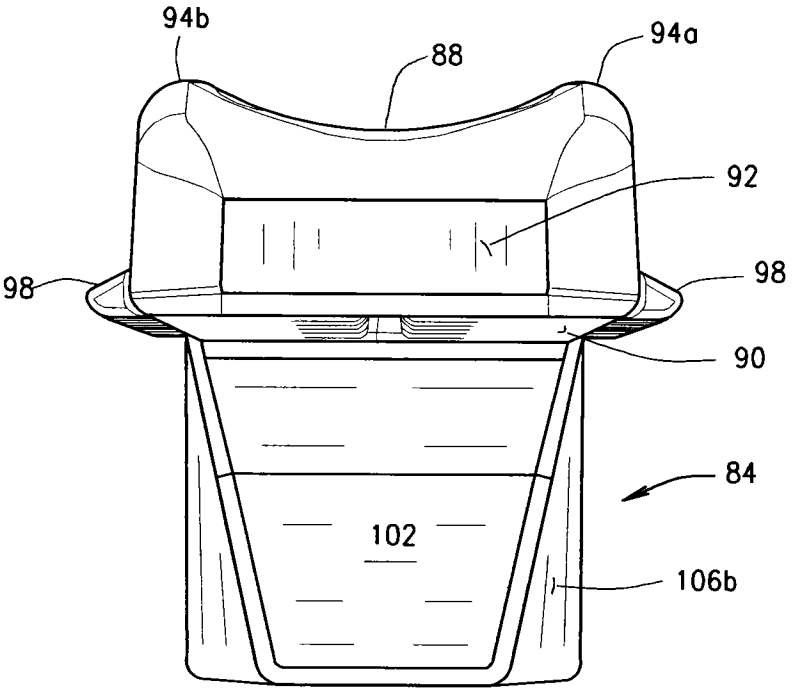
FIG. 16 is a front end elevational view of the long bunk
Figure 15:
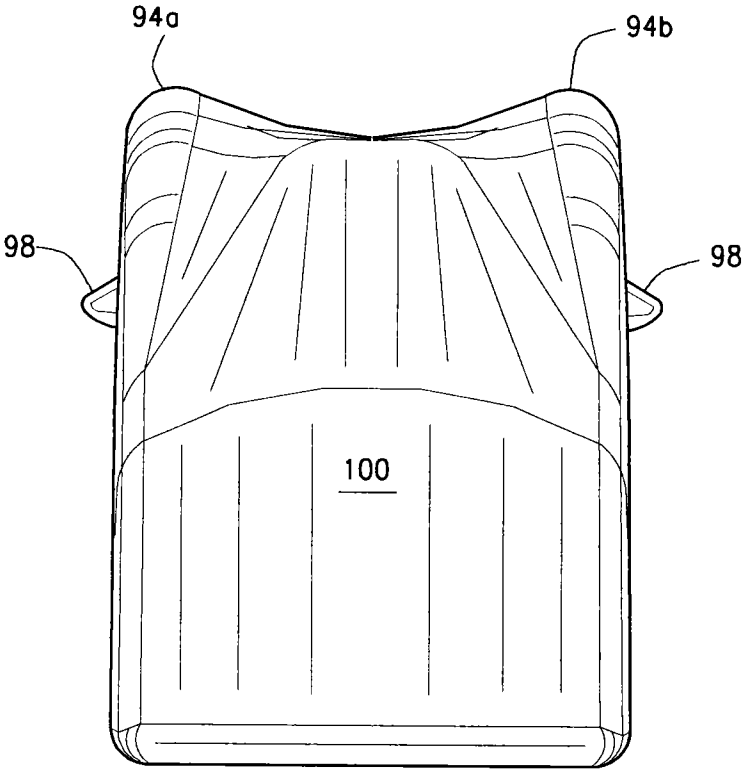
FIG. 15 is a rear end elevational view of the long bunk.
Figure 18:
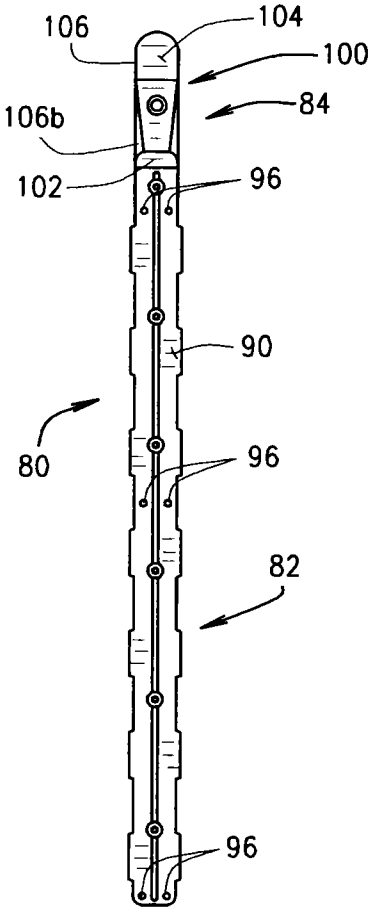
FIG. 18 is a bottom plan view of the long bunk.
Figure 17:
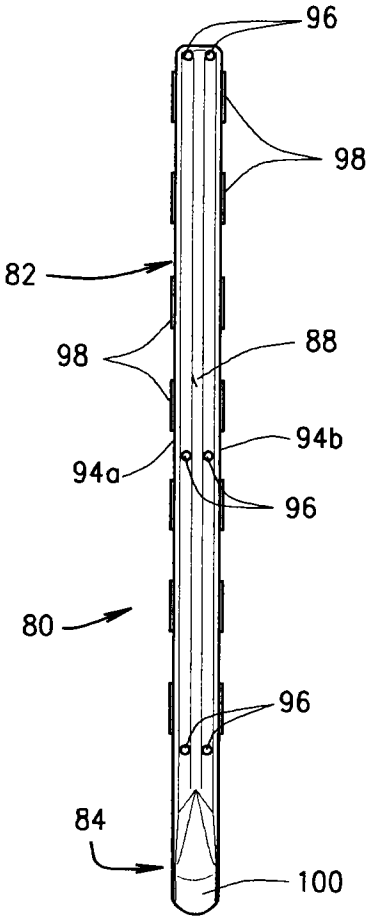
FIG. 17 is a top plan view of the long bunk.

The ramp portion 84 of the long bunk 80 includes a sloped ramp surface 100, a generally vertical forward wall 102, a bottom 104, and a side wall 106. The side wall 106 has a first portion 106*a* which is generally parallel to the side wall 86 of the rail portion 82, and a portion 106*b* that slopes inwardly and downwardly. Thus, the forward wall 102, as best seen in FIG. 16, is generally trapezoidal, with the bottom edge of the wall 102 being shorter in width than the top of the wall 102, and the front wall 102 being generally narrower from side-to-side than the ramp surface 100. The front wall 102 has a height which is at least as tall as the back edge 28 of the watercraft lit 10, such that the bottom 104 of the bunk's ramp portion 84 will be at or below the bottom surface of the watercraft lift 10. This is best seen in the cross-section of FIG. 12A.

Unlike the bunk 50, the bunk 80 provides a ramp surface, which a watercraft will contact prior to contacting the lift 10 providing for a soft (less abrupt) ride onto the lift 10. Thus, the initial impact of the watercraft against the rear edge 28 of the lift will not be as harsh as it might be when the lift is fitted with the short bunks 50. The bunk 80 (and in particular, the ramp surface 100) can be considered sacrificial. Because the bunk 80 will bear the initial impact from the watercraft, the rear edge of the lift 10 will not be degraded as quickly as it might be if the bunks 80 did not provide a ramp surface. When the ramp surface 100 is no longer useful, the bunks 80 can be replaced. Hence, the bunks 80 can extend the useful life of the lift 10. Unlike the short bunks 50, the long bunks 80 are symmetrical about a vertical plane extending through the length of, and through the center of the bunks. Thus, unlike the bunks 50, the bunks 80 cannot be mounted in different positions to accept different sized watercraft.

In practice, the lift 10 may be fitted with the short bunks 50 when smaller watercraft, such as PWC's and boats having a length less than 20' for example, are docked on the lift 10. However, the lift 10 may be fitted with the long bunks 80 when larger (and heavier) watercraft are docked on the lift 10, for it is with the larger and heavier watercraft that the life-extending properties of the long bunk (i.e., the benefits of the ramp surface 100) become more pronounced.

As various changes could be made in the above constructions without departing from the scope of the claimed invention, it is intended that all matter contained in the above description or shown in the accompanying drawings shall be interpreted as illustrative and not in a limiting sense.

The invention claimed is:

1. A drive-on watercraft lift, comprising:

a body including an upper surface, side walls, a front wall, and a back wall; a hull receiving channel formed in said upper surface, said hull receiving channel defining an entrance onto said lift; a first bunk receiving slot formed in said upper surface on a first side of said hull receiving channel and a second bunk receiving slot formed in said upper surface on a second side of said hull receiving channel, said first and second bunk receiving slots extending forwardly from said back wall; and a bunk secured in each of said bunk receiving slots; said bunks each comprising a bottom surface, a first side wall, a second side wall opposite said first side wall, and an upper surface; said upper surface of said bunk defining a first elongate rail and a second elongate rail, said first and second rails being generally parallel to each other and spaced apart from each other; said bunk being selectively positioned in said body such that the hull of a watercraft will rest upon at least a selected one of said first and second rails when said watercraft is positioned on said lift;

said bunk receiving slots of said body and said bunks being configured to enable said bunks to be removably secured in said bunk receiving slots;

said watercraft lift body further including fastener receiving holes in each said bunk receiving slot; said bunks each including a plurality of fastener receiving holes, each fastener receiving hole on said bunks being positioned to be aligned with a fastener receiving hole on said lift body when said bunk is positioned in said slot; said drive-on watercraft lift further including fasteners which extend through the fastener receiving holes of said bunks into the fastener receiving holes of said body.

2. The drive-on watercraft lift of claim 1 wherein said bunks are shorter than said bunk receiving slots of said body; said bunks including flanges extending from front and rear ends thereof; said fastener receiving openings in said bunk being formed in said front and rear flanges.

3. The drive-on watercraft lift of claim 1 wherein said fastener receiving openings of said bunks open to said upper surface of said bunks.

4. The drive-on watercraft lift of claim 1 wherein said bunk upper surface is generally concave, whereby said first rail is associated with said first side wall and said second rail is associated with said second side wall.

5. The drive-on watercraft lift of claim 4 wherein said first side wall is taller then said second side wall, such that said first rail is vertically above the second side rail.

6. The drive-on watercraft lift of claim 4 wherein said bunk is generally symmetrical about a vertical plane extending the length of said bunk and extending through the center of said bunk.

7. The drive-on watercraft lift of claim 1 wherein said bunks each include a ramp portion positioned at a rear end of said rail; said ramp portion comprising a sloping ramp surface, opposed side walls and a front wall; said ramp portion front wall having a height at least equal to a height of said rear wall of said lift body.

8. A drive-on watercraft lift, comprising:

a body including an upper surface, side walls, a front wall, and a back wall; a hull receiving channel formed in said upper surface, said hull receiving channel defining an entrance onto said lift; a first bunk receiving slot formed in said upper surface on a first side of said hull receiving channel and a second bunk receiving slot formed in said upper surface on a second side of said hull receiving channel, said bunk receiving slots extending forwardly from said back wall;

a bunk secured in each of said bunk receiving slots; said bunks each comprising a bottom surface, a first side wall, a second side wall opposite said first side wall, and an upper surface; said upper surface of said bunks being generally concave and defining a first elongate rail associated with said first side wall and a second elongate rail associated with said second side wall, said first and second rails being generally parallel to each other and spaced apart from each other; said first side wall being taller then said second side wall, such that said first rail is vertically above the second side rail; said bunk being selectively positioned in said body such that the hull of a watercraft will rest upon at least a selected one of said first and second rails when said watercraft is positioned on said lift; said bunks being positionable in said bunk receiving slots with either the first or second side wall facing inwardly; and said bunk receiving slots of said lift body and said bunks being configured to enable said bunks to be removably secured in said bunk receiving slots.

9. The drive-on watercraft lift of claim 8 wherein said bunks are frictionally received in said bunk receiving slots.

10. The drive-on watercraft lift of claim 9 wherein said bunk includes at least one side flange extending outwardly from the bottom of at least one of said side walls of said bunk; said side flange giving the bunk an overall width approximately equal to the width of the bunk receiving slot.

* * * * *